US008444021B1

(12) United States Patent
Ferreiro

(10) Patent No.: US 8,444,021 B1
(45) Date of Patent: May 21, 2013

(54) WATER ON DEMAND BAG

(76) Inventor: Roxanne Ferreiro, Weston, MA (US)

( * ) Notice: Subject to any disclaimer, the term of this patent is extended or adjusted under 35 U.S.C. 154(b) by 182 days.

(21) Appl. No.: 12/928,144

(22) Filed: Dec. 3, 2010

Related U.S. Application Data

(60) Provisional application No. 61/283,398, filed on Dec. 3, 2009.

(51) Int. Cl.
*B67D 7/84* (2010.01)

(52) U.S. Cl.
USPC ..... 222/175; 224/148.2

(58) Field of Classification Search
USPC ..... 222/174, 92, 175; 224/148.1–148.7; 220/703–723; 383/200–209
See application file for complete search history.

(56) References Cited

U.S. PATENT DOCUMENTS

| | | | | |
|---|---|---|---|---|
| 33,343 | A | 9/1861 | Garrick | |
| 357,272 | A | 2/1887 | Donavin | |
| 1,637,635 | A | 8/1927 | Corley | |
| 2,013,358 | A | 9/1935 | Osborne | |
| 3,930,286 | A | 1/1976 | McGowen | |
| 4,057,731 | A * | 11/1977 | Loseff | 378/167 |
| 4,090,650 | A | 5/1978 | Gotta | |
| 4,139,130 | A | 2/1979 | Glusker et al. | |
| 4,189,075 | A | 2/1980 | Hall | |
| 4,420,097 | A | 12/1983 | Motsenbocker | |
| 4,449,654 | A | 5/1984 | Cappis | |
| 4,526,298 | A | 7/1985 | Boxer et al. | |
| 4,818,544 | A | 4/1989 | Seward | |
| 4,903,718 | A * | 2/1990 | Sullivan | 134/184 |
| 4,948,023 | A | 8/1990 | Tripp | |
| D310,296 | S * | 9/1990 | Janus | D3/202 |
| 5,060,833 | A | 10/1991 | Edison et al. | |
| 5,085,349 | A | 2/1992 | Fawcett | |
| 5,115,947 | A | 5/1992 | McDonnell et al. | |
| 5,167,354 | A * | 12/1992 | Cohanfard | 224/148.2 |
| 5,207,719 | A * | 5/1993 | Janus | 224/148.2 |
| 5,358,142 | A | 10/1994 | Holmes | |
| 5,427,290 | A | 6/1995 | Thatcher | |
| 5,566,869 | A * | 10/1996 | Katz | 224/148.6 |
| 5,645,404 | A | 7/1997 | Zelenak | |
| 5,722,573 | A | 3/1998 | Carnel | |
| 5,727,714 | A | 3/1998 | Fawcett | |
| 5,788,121 | A | 8/1998 | Sasaki et al. | |
| 5,816,457 | A | 10/1998 | Croft | |
| 5,941,640 | A | 8/1999 | Thatcher | |
| 6,039,305 | A | 3/2000 | Hoskins et al. | |
| 6,220,490 | B1 | 4/2001 | O'Hara | |
| 6,497,348 | B2 | 12/2002 | Forsman et al. | |
| 6,742,681 | B1 | 6/2004 | Yang | |
| 6,749,090 | B2 | 6/2004 | Bailey | |
| 6,837,026 | B2 | 1/2005 | Setton | |
| 7,073,688 | B2 | 7/2006 | Choi et al. | |
| 7,311,231 | B2 | 12/2007 | Noell et al. | |
| D587,007 | S | 2/2009 | Phillips, III | |
| 7,509,692 | B2 | 3/2009 | Elkins et al. | |

(Continued)

FOREIGN PATENT DOCUMENTS

| | | | | |
|---|---|---|---|---|
| JP | 58-76178 | * | 5/1983 | 220/703 |

*Primary Examiner* — Lien Ngo
(74) *Attorney, Agent, or Firm* — John P. McGonagle

(57) ABSTRACT

A portable, disposable water pack. The water pack is comprised of a light weight, water impervious bag having an opening with a water tube inserted there through. The invention pack has two plastic handle strips attached thereto. The invention pack also has a preformed, tear-down notch formed therein.

4 Claims, 9 Drawing Sheets

U.S. PATENT DOCUMENTS

| | | | | |
|---|---|---|---|---|
| 7,552,734 | B2 | 6/2009 | Adams | |
| D597,856 | S | 8/2009 | Sherrill et al. | |
| 7,823,802 | B1 * | 11/2010 | Roche et al. | 239/33 |
| 2003/0128900 | A1 * | 7/2003 | Lawrie et al. | 383/202 |
| 2004/0161177 | A1 * | 8/2004 | N'Dia | 383/202 |
| 2006/0285782 | A1 * | 12/2006 | Walker et al. | 383/200 |
| 2007/0034594 | A1 * | 2/2007 | Doucet et al. | 215/309 |
| 2007/0090135 | A1 | 4/2007 | Benham | |
| 2007/0108238 | A1 | 5/2007 | Kirker | |
| 2008/0169321 | A1 | 7/2008 | Fidrych et al. | |
| 2008/0185408 | A1 | 8/2008 | James | |
| 2008/0217367 | A1 | 9/2008 | Lillie | |
| 2008/0233252 | A1 * | 9/2008 | Manning et al. | 426/412 |
| 2009/0236378 | A1 | 9/2009 | Crye | |
| 2009/0304873 | A1 * | 12/2009 | Magnoni | 426/122 |

* cited by examiner

WATER ON DEMAND BAG

CROSS-REFERENCE TO RELATED APPLICATIONS

Applicant claims the priority benefits of U.S. Provisional Patent Application No. 61/283,398, filed Dec. 3, 2009.

BACKGROUND OF THE INVENTION

This invention relates generally to the field of water-holding containers and, in particular, to a portable, disposable water bag.

Portable water packs have become beneficial to active people, including sports enthusiasts, hikers, runners, hunters, military people, and the like. The prior art describes many versions of portable water packs. However, most are refillable, requiring a sturdy construction with means for refilling and cleaning the packs.

SUMMARY OF THE INVENTION

The present invention provides a portable water pack which is entirely disposable. The invention pack is comprised of a light weight, water impervious bag having an opening with a water tube inserted there through. The invention pack has two plastic handle strips attached thereto. The invention pack also has a preformed, tear-down notch formed therein.

These together with other objects of the invention, along with various features of novelty which characterize the invention, are pointed out with particularity in the following disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
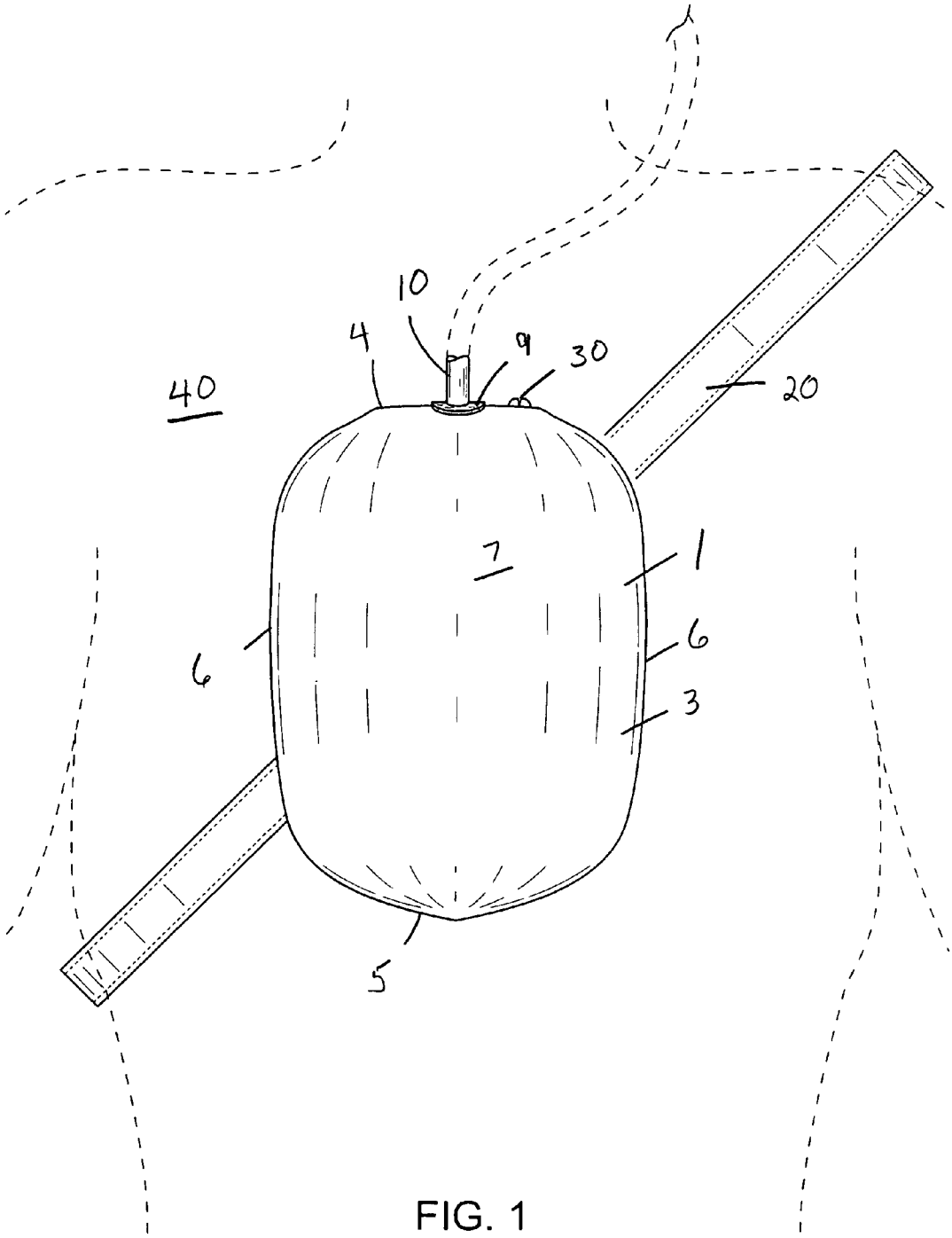
FIG. 1 is a rear view of an invention water bag with holding straps deployed.
Figure 3:
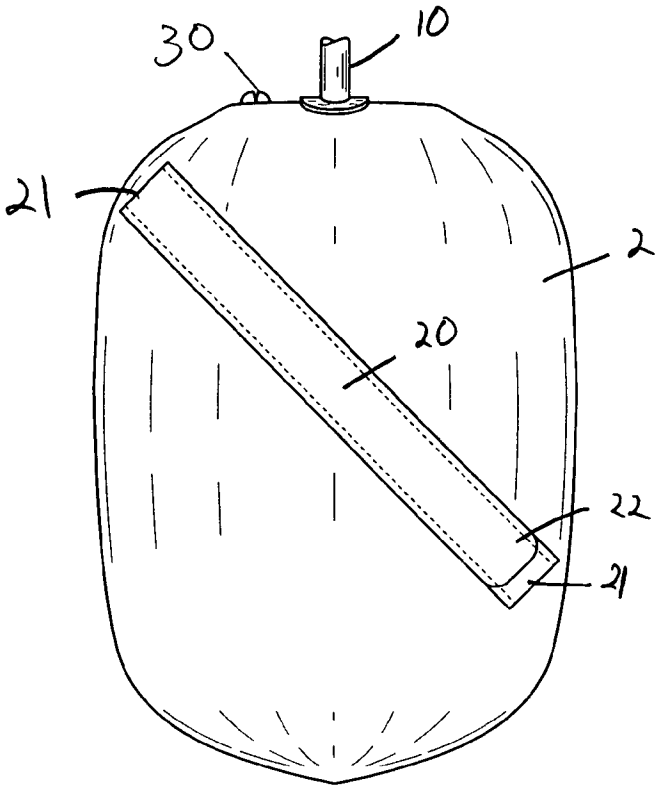
FIG. 3 is a front view of the water bag.
Figure 2:
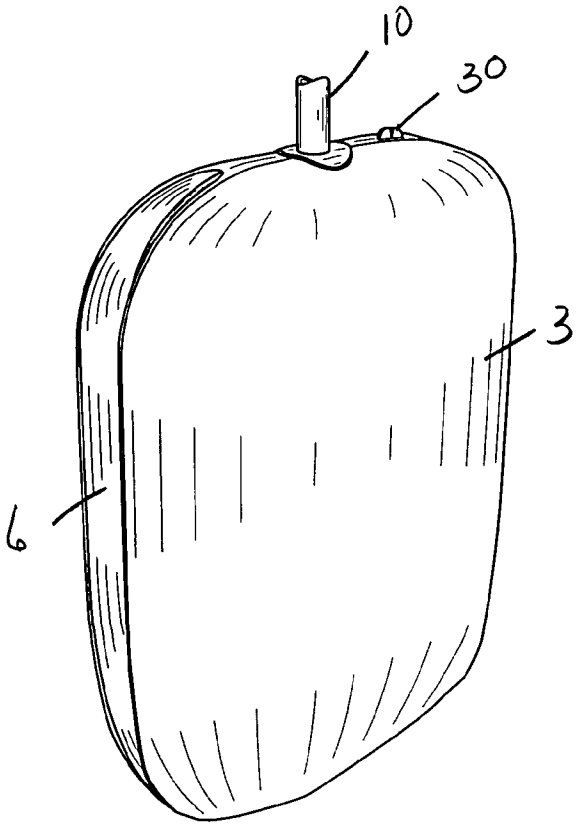
FIG. 2 is rear perspective view with holding straps folded and attached to the water bag front.
Figure 5:
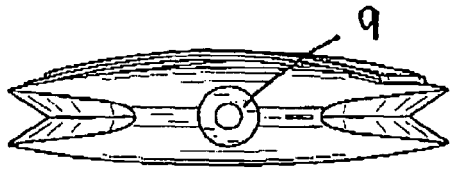
FIG. 5 is a top view of the water bag.
Figure 4A:
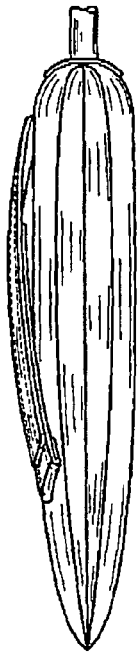
FIG. 4A is a right side view of the water bag.
Figure 6:
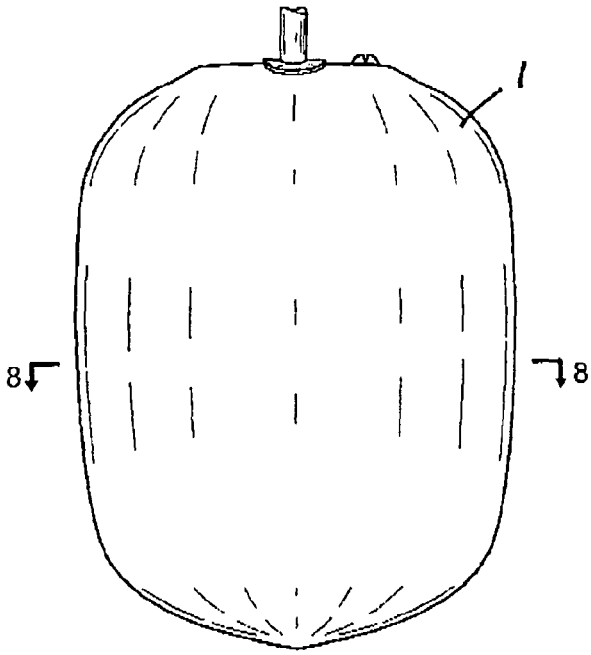
FIG. 6 is a rear view of the water bag.
Figure 4B:
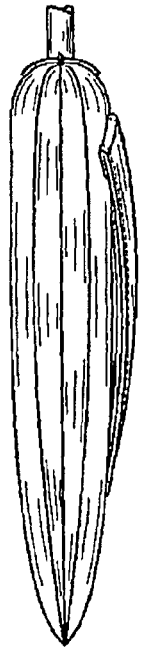
FIG. 4B is a left side view of the water bag.
Figure 7:
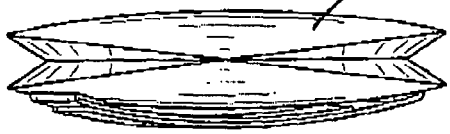
FIG. 7 is a bottom view of the water bag.
Figure 8:
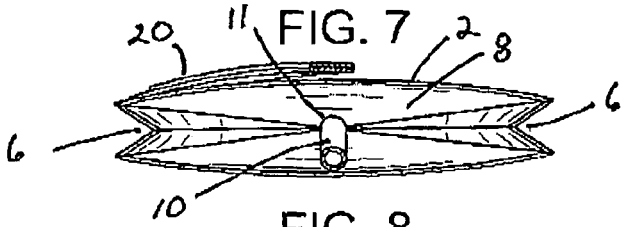
FIG. 8 is a cross sectional view of the water bag along the line 8-8 of FIG. 6.

Referring to the drawings in detail wherein like elements are indicated by like numerals, there is shown a water on demand bag 1. The bag 1 has a front 2, rear 3, top 4, bottom 5, two opposite sides 6, an exterior surface 7, and an interior 8 defined by said bag front, rear, top, bottom and sides. The bag sides 6 are formed into gussets for bag expansion. The bag bottom 5 may be formed into a general "V" shape to allowing maximum access to the bag contents.

The bag top 4 has a reinforced aperture 9 formed therein, through which a drinking tube 10 is inserted and extending into the bag interior 8 along the front 2 or rear 3 near to the bag bottom 5. The drinking tube 10 is comprised of an elongated body 13 with two open ends, one end 11 positioned within the bag interior 8 and the other end 12 protruding external from the bag interior. The drink tube body portion 14 within the bag interior 8 may be fused centrally along the bag front 2 or rear 3.

The bag front 2 has two handle straps 20 attached to the bag exterior surface 7 and folded one along the other. Each handle strap has two ends, one end 21 attached to the bag front 2 near to a side 6 and the other end 22 releasably attached to the opposite handle strap. Each strap fee end 22 has an adjacent adhesive area 23 covered by a removable paper tab 24.

Figure 9:
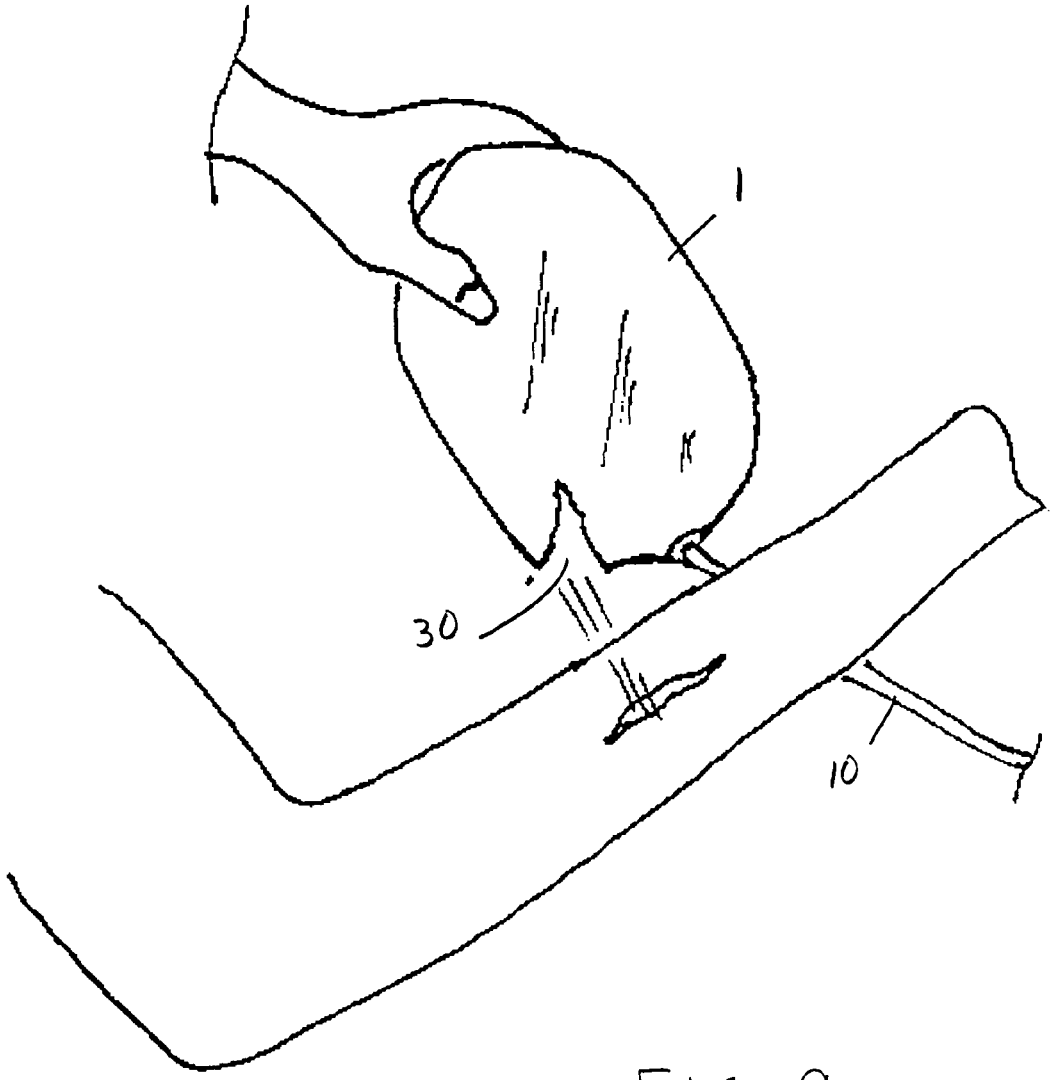
FIG. 9 is a view of the water bag tear open feature in use.
Figure 10:
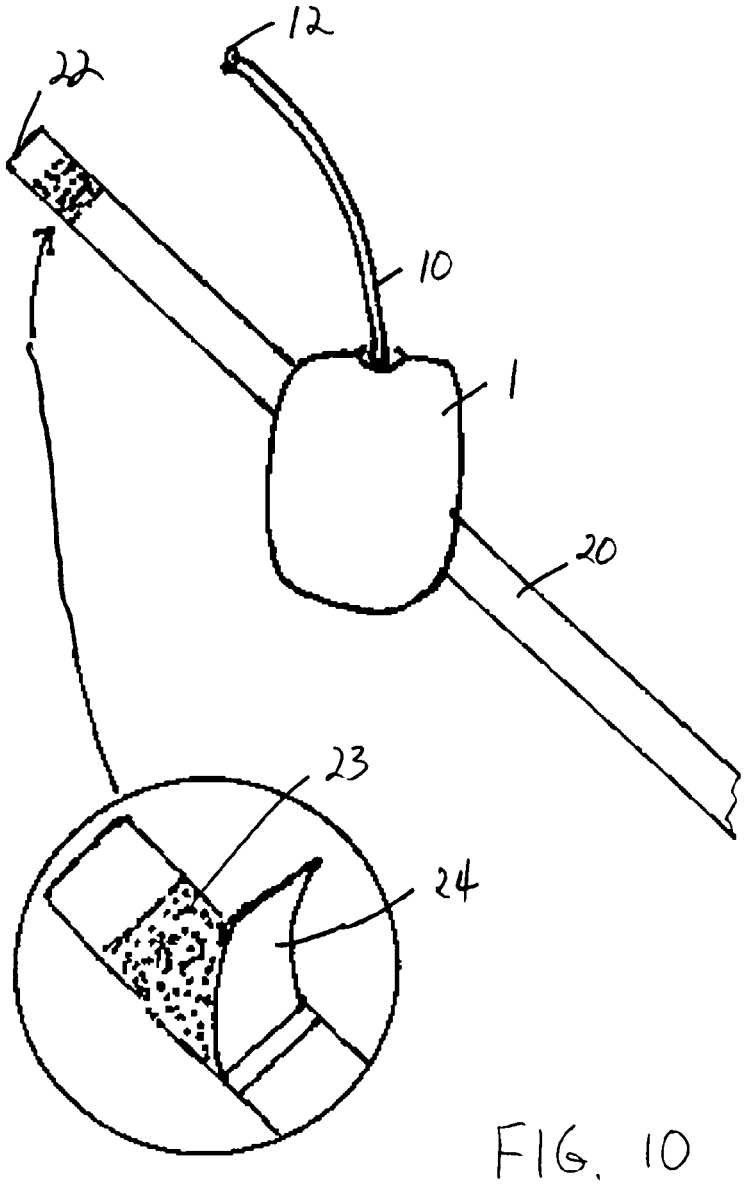
FIG. 10 illustrates one of the holding strap ends.

The bag top has a tear-down notch 30 formed therein, said notch 30 adapted to being torn open for full access to the contents of the bag interior 8. This permits the bag contents to be poured onto a wound or other area needing cleaning, or into a container. See FIG. 9.

Figure 11:
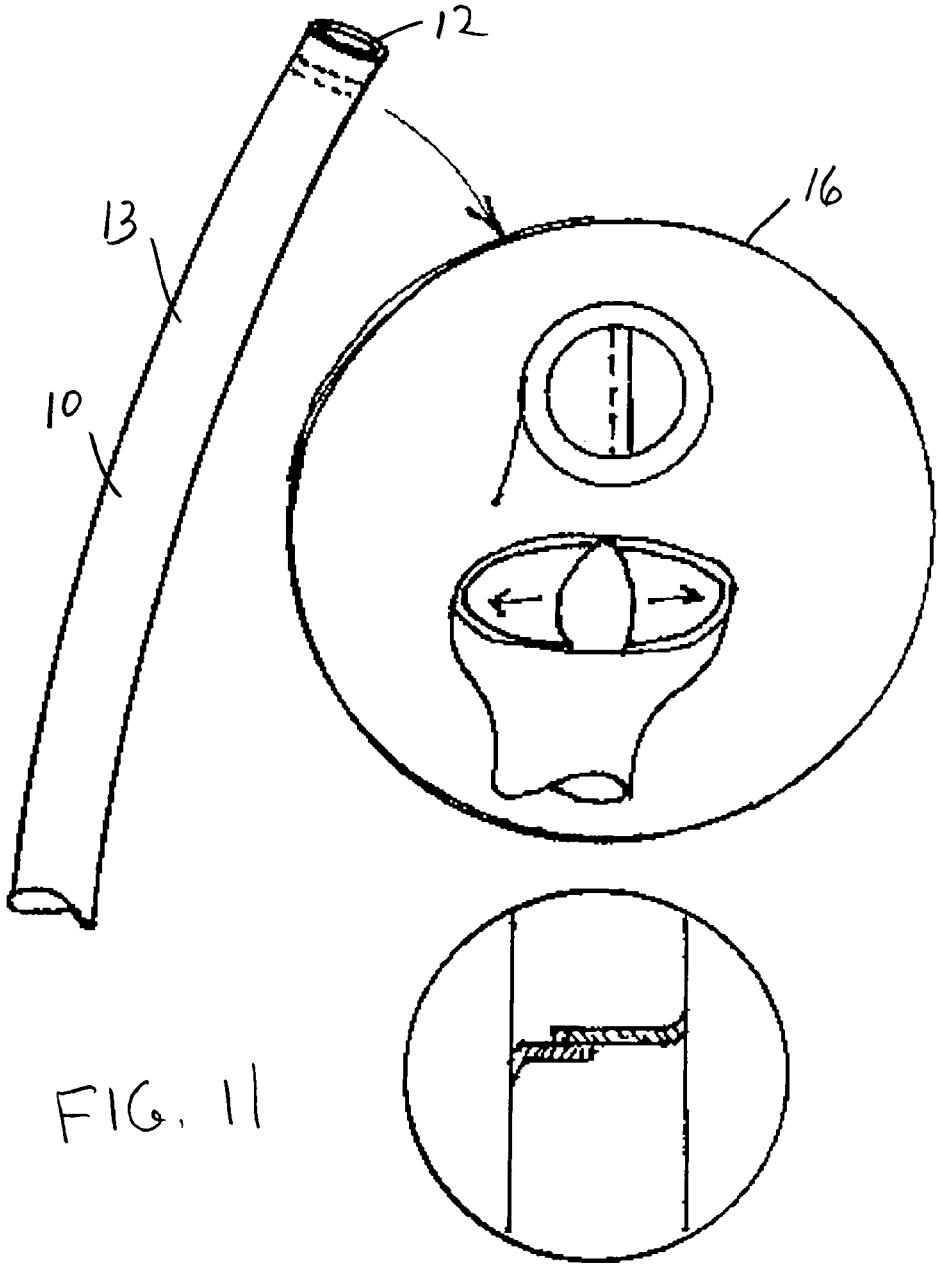
FIG. 11 illustrates a drinking tube with bite and drink feature.
Figure 13:
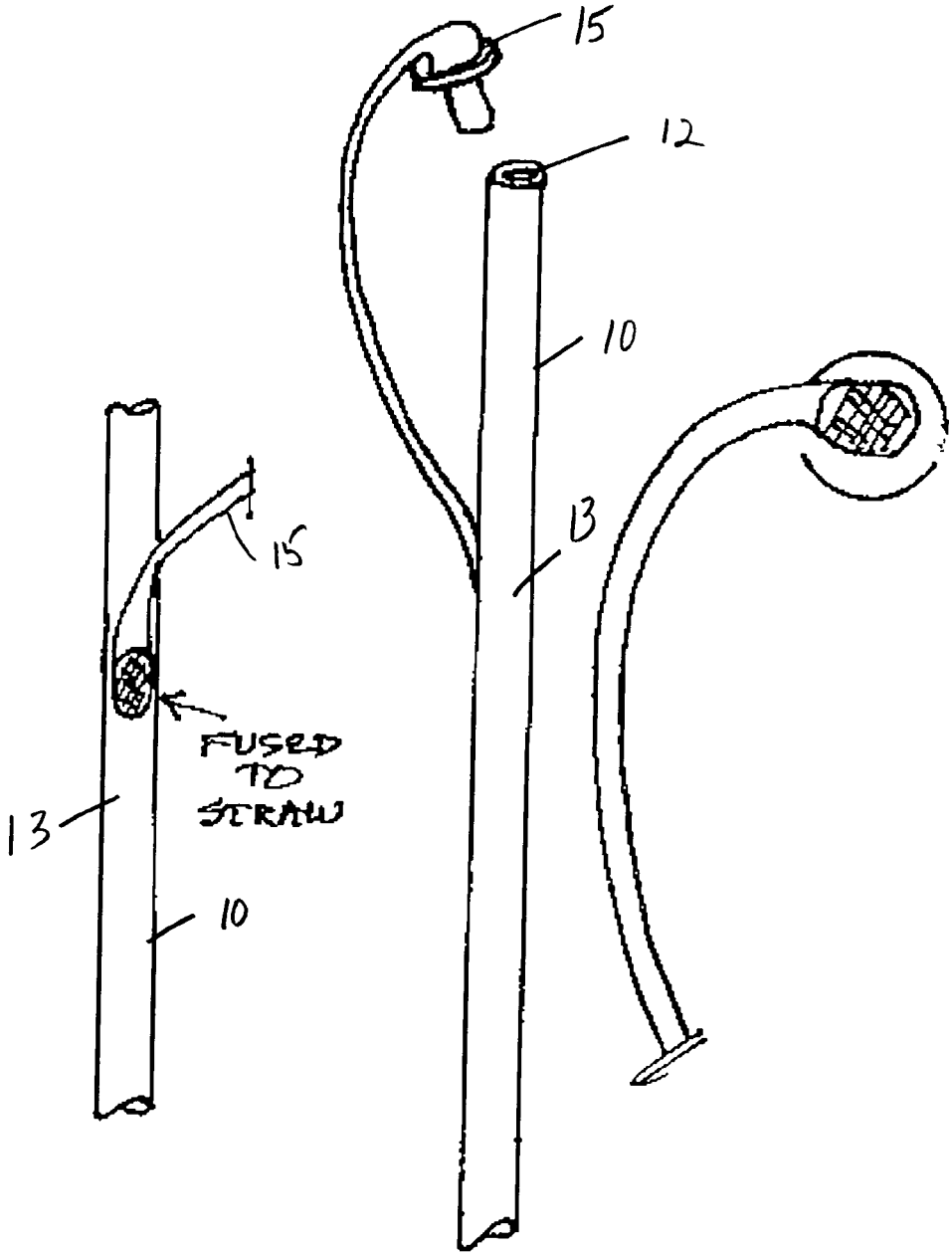
FIG. 13 illustrates a drinking tube cap.

The drinking tube external end 12 may terminate in a bite and drink feature 16. The drinking tube 10 may also have a cap 15 attached to its body 13 and removably inserted into the drinking tube exterior end 12. See FIGS. 11 and 13.

Figure 12:
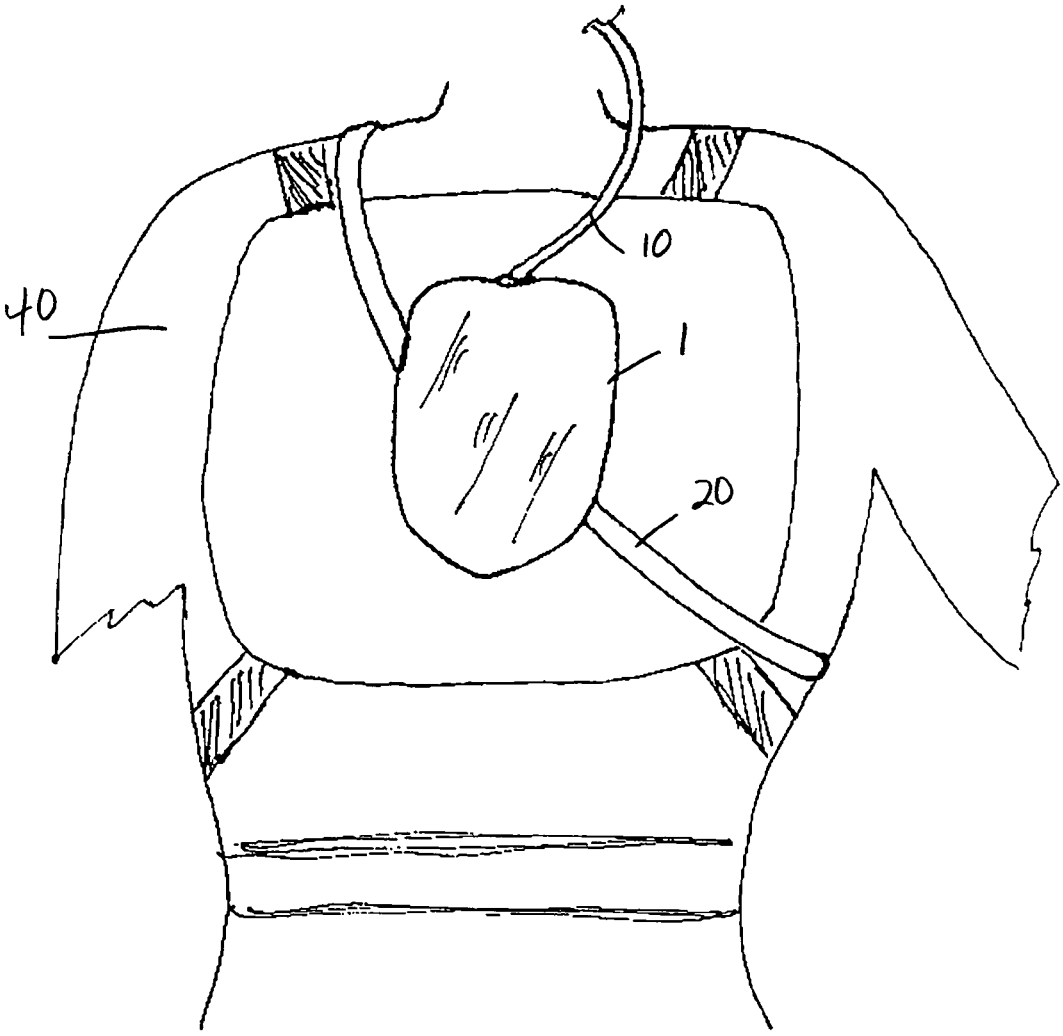
FIG. 12 is a rear view of the water bag in use.

As may be seen most clearly in FIGS. 1 and 12, the bag 1 is adapted to being attached about the torso 40 of a user, said bag attached by means of the handle straps 20 and joined together by means of the adhesive patches 23. The drinking tube exterior end 12 extends to the user's mouth (not shown) providing access to the bag contents.

Figure 14:
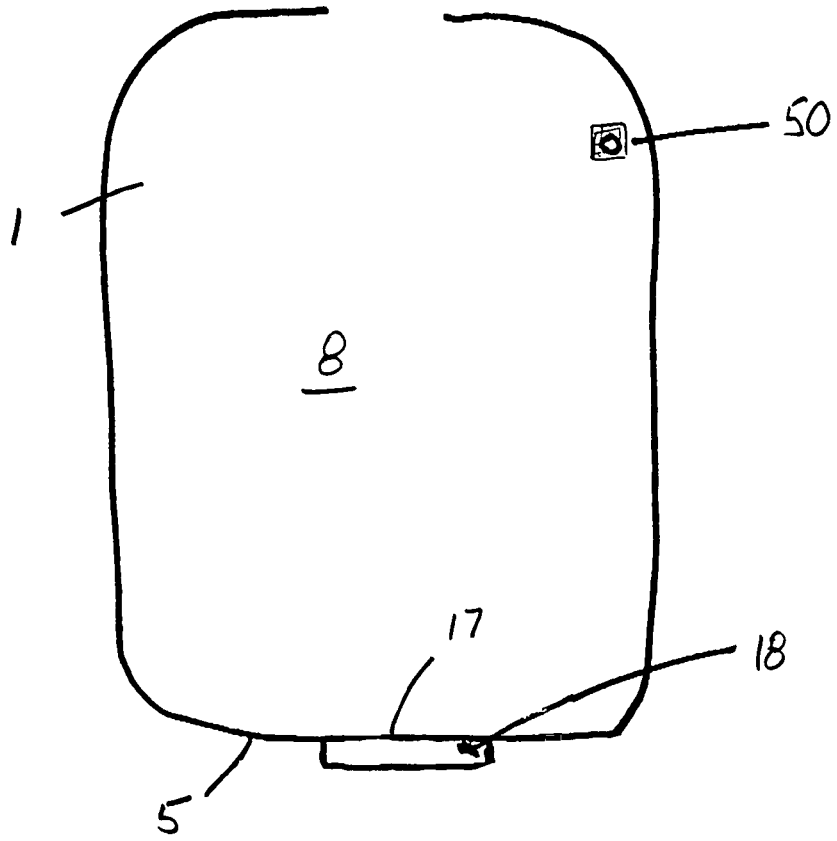
FIG. 14 illustrates a water bag with a quick filling tab.

A purification capsule 50 may be attached to one of the interior walls of the water bag, either directly or inserted into a mesh patch 51 attached to one of the water bag interior walls. The capsule 50 is adapted to interact with water. Once the water bag 1 is filled with water, the capsule decontaminates the water. See FIG. 14.

The water bag bottom 5 may have an aperture 17 sealable by means of an adhesive strip 18. This is intended to be a one-time sealable aperture. The end user would have the means for opening the water bag bottom, filling the bag with water, and then sealing the bottom.

It is understood that the above-described embodiment is merely illustrative of the application. Other embodiments may be readily devised by those skilled in the art which will embody the principles of the invention and fall within the spirit and scope thereof.

I claim:

1. A water on demand bag, comprising:

a light weight, water impervious bag having a front, rear, top, bottom, two opposite sides, an exterior surface, and an interior defined by said bag front, rear, top, bottom and sides;

reinforced formed in the bag top;

a hollow drinking tube inserted through said reinforced aperture and extending into the bag interior along the front or rear near to the bag bottom, said drinking tube having an elongated body with two open ends, one end positioned within the bag interior and the other end protruding external from the bag interior;

two handle straps attached to the bag exterior surface on the bag front and folded one along the other, each handle strap having two ends, one end attached to the bag front near to a side and the other end releasably attached to the opposite handle strap;

a tear-down notch formed in the bag top, said notch adapted to being torn open for full access to the contents of the bag interior;

a purification capsule attached to an interior wall of the bag, said capsule adapted to interact with water; and an aperture in the bag bottom, said aperture sealable by means of an adhesive strip.

2. A water on demand bag as recited in claim 1, further comprising:

a cap attached to the drinking tube body, said cap removably inserted into the drinking tube exterior end.

3. A water on demand bag as recited in claim 2, wherein:

each strap end has an adjacent adhesive area covered by a removable paper tab.

4. A water on demand bag as recited in claim 3, wherein:

said purification capsule is inserted into a mesh patch attached to one of said bag interior walls.

* * * * *